US006343572B1

(12) United States Patent
Pfaff et al.

(10) Patent No.: US 6,343,572 B1
(45) Date of Patent: Feb. 5, 2002

(54) METHOD FOR REGULATING HEAT IN AN INTERNAL COMBUSTION ENGINE

(75) Inventors: Ruediger Pfaff, Stuttgart; Joachim Wiltschika, Fellbach, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/462,183

(22) PCT Filed: Jun. 27, 1998

(86) PCT No.: PCT/EP98/03945

§ 371 Date: Jan. 3, 2000

§ 102(e) Date: Jan. 3, 2000

(87) PCT Pub. No.: WO99/01650

PCT Pub. Date: Jan. 14, 1999

(30) Foreign Application Priority Data

Jul. 3, 1997 (DE) ..... 197 28 351

(51) Int. Cl.[7] ..... F01P 9/00

(52) U.S. Cl. ..... 123/41.01; 123/41.12; 123/41.31; 123/41.44

(58) Field of Search ..... 123/41.01, 41.12, 123/41.02, 41.05, 41.31, 41.33, 41.06, 41.44

(56) References Cited

U.S. PATENT DOCUMENTS

| | | | | |
|---|---|---|---|---|
| 3,874,347 A | * | 4/1975 | Hovey | 123/41.12 |
| 4,546,742 A | * | 10/1985 | Sturges | 123/41.05 |
| 4,768,484 A | | 9/1988 | Scarselletta | 123/41.21 |
| 5,036,803 A | * | 8/1991 | Nolting et al. | 123/41.1 |
| 5,390,632 A | * | 2/1995 | Ikebe et al. | 123/41.02 |
| 5,482,010 A | | 1/1996 | Lemberger | 123/41.1 |
| 6,142,108 A | * | 11/2000 | Blichmann | 123/41.05 |

FOREIGN PATENT DOCUMENTS

| | | |
|---|---|---|
| DE | 196 44 303 A1 | 10/1996 |
| DE | 197 28 351.9 | 7/1998 |
| EP | 0 499 071 A1 | 1/1992 |
| EP | 0 744 538 A2 | 4/1996 |
| JP | 61083422 | 4/1986 |
| JP | 63016122 | 1/1988 |

* cited by examiner

*Primary Examiner*—Willis R. Wolfe
*Assistant Examiner*—Katrina B. Harris
(74) *Attorney, Agent, or Firm*—Crowell & Moring LLP

(57) ABSTRACT

A method of regulating heat in a internal combustion engine by measuring temperature at a plurality of points and providing changes in temperature for the cooling and providing changes in temperature for the cooling and/or heating medium. The regulation of the heat of the internal combustion engine results from detecting and monitoring changes in critical component temperatures and/or characteristic output values of the internal combustion engine. These critical component temperature changes per unit time and/or output characteristic value changes per unit time are used in the regulation of the heat of the internal combustion engine.

10 Claims, 1 Drawing Sheet

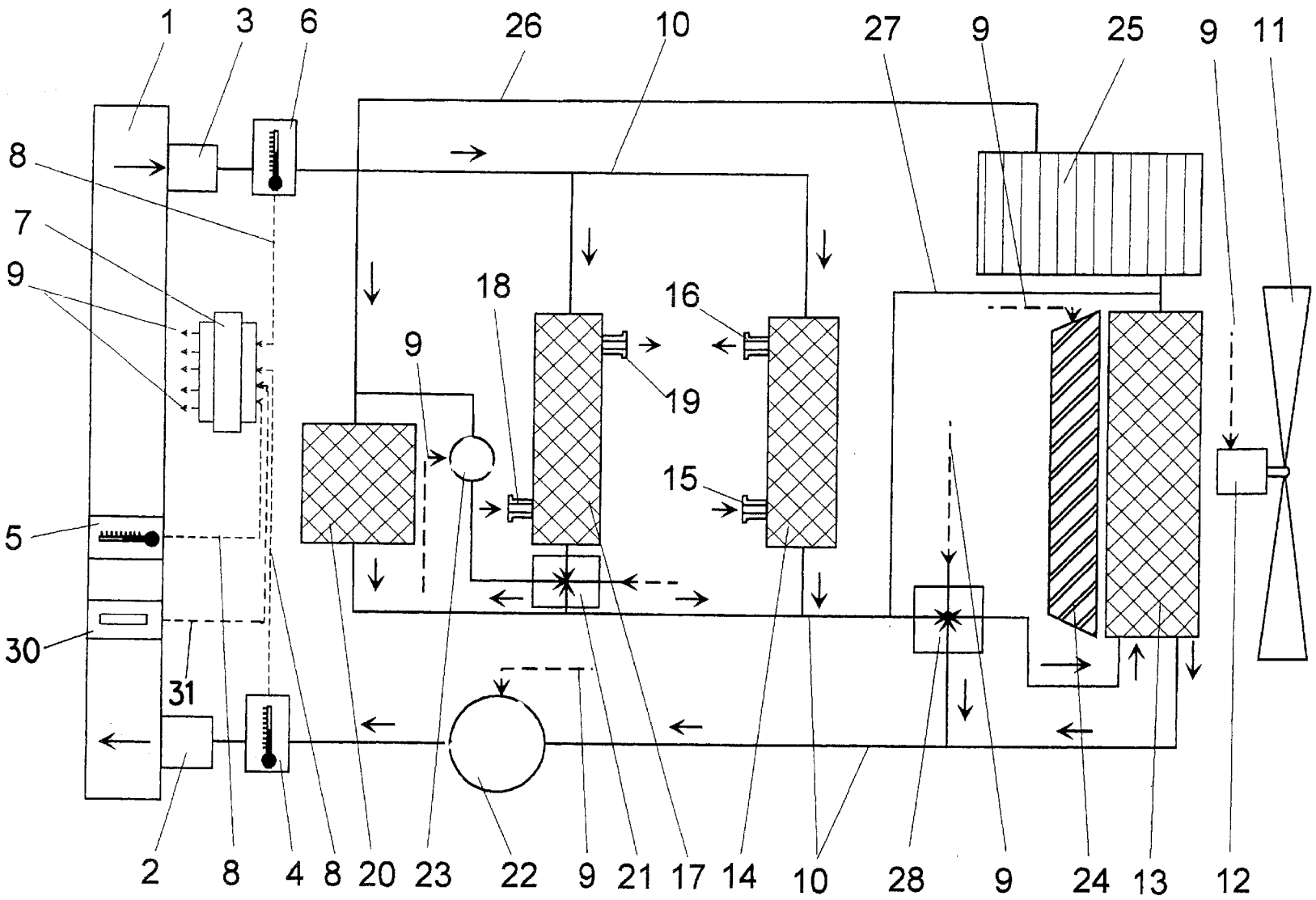
11
9
25
9
27
10
26
6
3
1
8
7
9
5
30
31
2
8
4
8
20
23
9
18
22
9
21
17
19
16
15
14
10
28
9
24
13
12

METHOD FOR REGULATING HEAT IN AN INTERNAL COMBUSTION ENGINE

The invention relates to a method of regulating the heat of an internal combustion engine for vehicles in accordance with the features of the precharacterizing clause of claim 1.

The management of the heat of an internal combustion engine and of a vehicle, that is to say the cooling and heating of units and devices to an optimum operating temperature, is of decisive importance for the efficiency and therefore for the vehicle system, especially with regard to economy, functioning, service life and comfort. It is therefore desirable for the devices and units, especially the internal combustion engine of the vehicle, to reach their optimum operating temperature as quickly as possible and maintain it as far as possible during the entire operation.

EP 0 499 071 A1 discloses a cooling system for a vehicle with an internal combustion engine. The cooling system comprises several circuits with associated heat exchangers. The temperatures of different cooling media are measured and are processed in a central evaluation device to form output signals by means of which electrically controllable devices, such as controlled-speed pumps, controlled-speed fans, electrically controllable valves and a louvre shutter arranged in the air flow path can be driven. For all the cooling circuits, the heat-exchanger capacity or the rotational speed of the fan is always directed towards the highest requirement of one of the cooling circuits. The central management of the heat achieves the situation where little drive energy has to be applied for pumps and fans for the cooling and heating of the system and not too much energy is extracted from the system. As a result, the required operating temperatures are reached quickly upon starting.

However, there is the difficulty to intervene in good time in the regulation of the heat, since the cooling medium temperatures used for the control are only established at a higher or lower temperature level relatively late after the actual accumulation of heat. In addition, the registration itself of the temperature is subject to considerable delays.

DE 37 38 412 A1 discloses a method for regulating the heat of an internal combustion engine, in which the delivery capacity of the electrical pumps is controlled not only as a function of the cooling-medium temperature but as a function of at least one further characteristic operating variable. For this purpose, an electronic switching device receives, as input signals, the operating temperature of the internal combustion engine, the air temperature in the immediate environment of the internal combustion engine, the ambient temperature which can be measured at a greater distance from the internal combustion engine, the temperature of engine parts and the rotational speed of the internal combustion engine, and information about the speed of travel of the vehicle. The electronic switching device processes the input signals to form output signals and initially outputs an output signal to the electric pump. Further output signals are output to the valves, if appropriate, and to an actuating device which operates an adjustable louvre shutter arranged in front of a heat exchanger used as a cooler, and finally to fan motors associated with heat exchangers.

EP 0 084 378 A1 discloses a control device for a cooling system of an internal combustion engine in which the input variables are evaluated by means of a microprocessor. The input variables used are the cooling-water temperature, the speed of the vehicle and the ambient temperature.

DE 38 10 174 A1 shows a device for regulating the cooling-medium temperature of an internal combustion engine, a regulating device or evaluation device receiving, as input signals, the load and the rotational speed of the internal combustion engine, in addition to the cooling-water temperature. The load on the internal combustion engine can be determined indirectly by measuring the intake-pipe vacuum of a mixture-compressing internal combustion engine, or by measuring the position of the control rod of an injection pump of an air-compressing internal combustion engine.

Furthermore, DE 41 09 498 discloses a method of regulating the temperature of an internal combustion engine in which a control device processes, as input signals, the following operating parameters: the temperature of the internal combustion engine, the intake temperature, the rotational speed of the internal combustion engine, the speed of the vehicle, the load on the internal combustion engine, the operating state of the air-conditioning system, the heating of the motor vehicle, the time, the diagnostic information, an output signal from a knock control device and the temperature of the cooling water.

In addition, DE 44 26 494 A1 discloses a device for monitoring the cooling system in an internal combustion engine. The serviceability of the cooling system is monitored by using a microprocessor, by the variation of a temperature signal being evaluated and detected temperature changes per unit time being compared with plausible values. The devaluation is not used to regulate the cooling system, but only to monitor it and to be able to detect misfunctions surely and reliably.

Finally, U.S. Pat. No. 4,768,484, which forms the generic type, discloses a method of regulating a thermal device in which, using a microprocessor, signals from temperature sensors are fed to an electronic evaluation unit having a microprocessor. However, the possibilities of (rapid) action on the development of heat are limited.

The invention is based on the object of proposing a method in which interventions in the heat regulation of the internal combustion engine can be made more rapidly and more directly.

According to the invention, this object is achieved by the features of claim 1. In the method according to the invention, in addition to the temperatures of the cooling or heating media, critical component temperatures and/or characteristic output values of the internal combustion engine are registered and taken into account in the regulation. Since the critical components react more directly to an increased accumulation of heat and their temperature changes considerably earlier, before the cooling-medium temperature reacts with a delay as a result of the transfer of heat, interventions in the heat regulation can be made rapidly. This is accelerated by the method according to the invention, by not only the component temperatures and/or characteristic output values as such, but changes per unit time being taken into account in the regulation. The trend of the temperature variation gives an important indication early on as to whether more intensive or less intensive cooling must be carried out.

A critical component which is suitable for this is the cylinder head of an internal combustion engine, specifically the region between outlet valves, the so-called web zone. Since this region is exposed to the hot exhaust gases, it is particularly threatened by high temperatures and frequent temperature changes. Because of its low mass and its position, it reacts very quickly to changes in the heat loading, so that its temperature is very characteristic of the accumulation of heat in the internal combustion engine.

According to the method of the invention, it is further proposed to register characteristic output values of the internal combustion engine which are specific to the heat behaviour, for example, expediently, the amount of fuel introduced into a combustion chamber per unit time or per working cycle. In this way it is possible to obtain a characteristic variable for the regulation before the actual accumulation of heat takes place or a critical component has reached the corresponding temperature. In principle, it is possible to register the temperatures and characteristic values of all the cylinders of an internal combustion engine. As a rule, however, it will be sufficient if only the values of the most critical cylinder or some cylinders are registered.

By means of the method according to the invention and its refinements, it is possible for the optimum operating temperatures to be reached particularly quickly in the starting phase of an internal combustion engine for vehicles if, as the temperature rises or the accumulation of heat builds up, from among the devices, first the pumps are put into operation and regulated, then the thermostats, then the louvre shutter and finally the fan.

The achievement of all these measures is that the combustion chamber is heated up very quickly after the start, with the result that the cylinder charging, both in spark-ignition and in diesel engines, burns better and therefore lower hydrocarbon emissions result. In addition, self-ignition in diesel engines is improved, as a result of which, even after a very short warm-up time, a more uniform and very quiet running with a considerably reduced emission of noise is reached. Because of low heat losses via the combustion-chamber wall, the idling rate, which is usually increased during starting, can be reduced considerably earlier, and the period during which the rate is increased can be shortened considerably. As a result, the thermal efficiency during these operating states is improved, and the fuel consumption is reduced.

Finally, the exhaust-gas temperatures rise very rapidly, as a result of which a catalytic converter responds more quickly, and the response behaviour of a turbocharger is improved. Since the regulation of the heat responds very quickly when the temperatures change or the accumulation of heat changes, the components of the internal combustion engine are better protected against thermal overloading. In addition, the lubricating oil is brought quickly to an optimum temperature, so that it develops its full functional capacity very soon, without its ageing being threatened by overloading.

An exemplary embodiment of the invention is illustrated in the drawing. Further advantages and details emerge from the following description of the exemplary embodiment. In the description and in the claims, numerous features are illustrated and described in conjunction. Those skilled in the art will expediently also consider the features individually and combine them into further practical combinations.

The drawing shows, in schematic form, the construction of a cooling system for implementing the method according to the invention.

1 designates a water-cooled internal combustion engine of a vehicle, which has a cooling-water inlet 2 and a cooling-water outlet 3. Temperature sensors 4 and 6 register the cooling-water temperature at the cooling-water inlet 2 and at the cooling-water outlet 3, respectively. In addition, the internal combustion engine 1 has a temperature sensor 5 in the region between the outlet valves, in the so-called "web zone". The temperature sensors 4, 5 and 6 conduct the temperature signals via signal lines 8 to an evaluation device 7, for example an engine electronics unit, which also registers characteristic output values of the internal combustion engine 1 which are specific to the accumulation of heat.

The evaluation device 7 converts the input variables and characteristic values into actuating variables. Via signal lines 9, which are illustrated by dashed lines, appropriate actuating signals are conducted to devices which can be driven electrically, in order to deliver cooling medium or heating medium, especially cooling water, cooling air and oil, and to regulate their volume flows. These devices include a fan 11, which is driven by a controllable electric motor 12, electrically driven and controllable water pumps 22 and 23, an electric thermostat 28 and an electrically driven louvre shutter 24.

The fan 11 delivers cooling air through a radiator 13, the throughput of cooling air through the radiator 13 being determined, on the one hand, by the rotational speed of the fan 11 and, on the other hand, when the fan 11 is switched off, by the position of the louvre shutter 24.

The water pump 22, which serves as the main pump, delivers the cooling water through the radiator 13 and the internal combustion engine 1 and through an oil cooler 14 having an oil inlet connecting piece 15 and an oil outlet connecting piece 16, through an exhaust-gas intercooler 17 having an exhaust-gas inlet connecting piece 18 and an exhaust-gas outlet connecting piece 19, and through an interior heating system 20. The flow direction of the cooling water is indicated by small arrows along the cooling-water lines 10. The cooling water system is connected to an expansion tank 25 via a balancing line 27 and a venting line 26.

The water pump 23, which serves as an additional pump, ensures the delivery of cooling water when the water pump 22 is stopped when there is a low accumulation of heat. It primarily ensures the functioning of the interior heating system 20, which can be controlled via a dual valve 21.

When the vehicle is started, initially the water pump 22 and the fan 11 are switched off, and the thermostat 28 and the louvre shutter 24 are closed. As the temperature increases, first the water pump 22 is put into operation and regulated in accordance with the accumulation of heat. After this, the regulation of the thermostat 28 begins. Finally, the louvre shutter 24 is opened and the fan 11 begins to regulate. If the temperature rises further, although all the devices are set to maximum values or because individual components have failed, for safety the output of the internal combustion engine is reduced appropriately.

Additionally a characteristic output value, which is specific to heat behavior, is the cylinder head of an internal combustion engine specifically, at the region between outlet valves. The sensor 30 provides the amount of fuel introduced into a combustion chamber per unit time or per working cycle through line 31. This sensor is positioned at the region between outlet valves, the so-called web zone. Since this region is exposed to the hot exhaust gases, it is particularly threatened by high temperatures and frequent temperature changes. Because of its low mass and its position, it reacts very quickly to changes in the heat loading, so that its temperature is very characteristic of the accumulation of heat in the internal combustion engine.

What is claimed is:

1. Method of regulating the heat of an internal combustion engine by using electrically controlled devices which deliver and regulate volume flow of a cooling medium or heating medium and through the use of temperature sensors at a number of points of the internal combustion engine which generates temperature-dependent signals, which are processed in an electronic evaluation unit wherein said unit includes at least one microprocessor to form actuating signals for a plurality of devices wherein temperatures of the cooling media and/or heating media are registered, said method comprising the steps of;

registering at least one of critical component temperatures and characteristic output values of the internal combustion engine;

detecting changes in said at least one of the critical component temperatures and the characteristic output values of the internal combustion engine;

providing regulation of said heat of the internal combustion engine as a function of said provided changes in said at least one critical component temperatures and said characteristic output values;

wherein the step of registering at least one of critical component temperatures and characteristic output values of the internal combustion engine includes the step of registering the temperature of a cylinder head in a region between output valves.

2. Method according to claim 1, wherein the step of registering temperatures of one of said cooling medium and said heating medium includes registering the temperature of a cylinder head in the region between output valves.

3. Method according to claim 1 wherein said plurality of devices comprise at least one electrically driven water pump, one of an electrically operated thermostat and a standard thermostat, one of an electrically driven fan and an electrically driven louvre shutter and, as the temperature rises or the accumulation of heat builds up, the regulation of the water pump followed by the regulation of the thermostat and subsequently the regulation of the louvre shutter and lastly the regulation of the fan.

4. Method according to claim 1 wherein said internal combustion engine is a multi-cylinder combustion engine and wherein only the values of the most critical cylinder are registered.

5. Method according to claim 1 wherein a water pump is used as the main pump which delivers cooling water through a radiator, the internal combustion engine, an oil cooler, an exhaust-gas intercooler and through an additional pump in order to ensure the delivery of cooling water when the water pump is stopped when there is little accumulation of heat.

6. Method of regulating the heat of an internal combustion engine by using electrically controlled devices which deliver and regulate volume flow of a cooling medium or heating medium and through the use of temperature sensors at a number of points of the internal combustion engine which generates temperature-dependent signals, which are processed in an electronic evaluation unit wherein said unit includes at least one microprocessor to form actuating signals for a plurality of devices wherein temperatures of the cooling media and/or heating media are registered, said method comprising the steps of;

registering at least one of critical component temperatures and characteristic output values of the internal combustion engine;

detecting changes in said at least one of the critical component temperatures and the characteristic output values of the internal combustion engine;

providing regulation of said heat of the internal combustion engine as a function of said provided changes in said at least one critical component temperatures and said characteristic output values; and registering the amount of fuel introduced into a combustion chamber per unit time or working cycle.

7. A method of regulating the heat of an internal combustion engine comprising the steps of;

sensing the temperature at a plurality of points of the internal combustion engine;

processing said sensed temperatures to provide a plurality of actuating signals;

registering changes in temperature of one a cooling medium and a heating medium in said internal combustion engine;

registering at least one of critical component temperatures and characteristic output values of the internal combustion engine;

detecting changes in said at least one of said critical component temperature and said characteristic output values; and regulating the heat of the internal combustion engine as a function of said detected changes wherein the step of registering at least one of critical component temperatures and characteristic output values includes the step of registering the temperature of a cylinder head in a region between output valves of said internal combustion engine.

8. The method according to claim 7 wherein the step of registering includes the step of registering the temperature of a cylinder head in the region between output valves of said internal combustion engine.

9. The method according to claim 7 wherein said internal combustion engine is a multi-cylinder engine and the step of registering includes registering only the values of at least one critical cylinder.

10. A method of regulating the heat of an internal combustion engine comprising the steps of;

sensing the temperature at a plurality of points of the internal combustion engine;

processing said sensed temperatures to provide a plurality of actuating signals;

registering changes in temperature of one a cooling medium and a heating medium in said internal combustion engine;

registering at least one of critical component temperatures and characteristic output values of the internal combustion engine;

detecting changes in said at least one of said critical component temperature and said characteristic output values; and regulating the heat of the internal combustion engine as a function of said detected changes wherein the step of registering includes at least one of critical component temperatures and characteristic values the step of registering the amount of fuel introduced into a combustion chamber per unit time or per working cycle.

* * * * *